United States Patent [19]

Franz

[11] 4,055,826

[45] Oct. 25, 1977

[54] RESILIENTLY SUPPORTED WINDINGS IN AN ELECTRICAL REACTOR

[75] Inventor: Joseph Phillip Franz, Erie, Pa.

[73] Assignee: General Electric Company, Erie, Pa.

[21] Appl. No.: 681,724

[22] Filed: Apr. 29, 1976

[51] Int. Cl.[2] ..... H01F 27/30

[52] U.S. Cl. ..... 336/100; 336/178; 336/197

[58] Field of Search ..... 336/197, 100, 60, 210, 336/178, 212; 310/214

[56] References Cited

U.S. PATENT DOCUMENTS

| | | | |
|---|---|---|---|
| 667,996 | 2/1901 | Schwedtmann et al. | 336/60 |
| 1,255,947 | 2/1918 | Thordarson | 336/100 X |
| 1,606,777 | 11/1926 | Payne | 336/178 X |
| 2,494,349 | 1/1950 | Mittermaier | 336/197 X |
| 3,158,770 | 11/1964 | Coggeshall et al. | 310/214 |
| 3,302,149 | 1/1967 | Forsha | 336/60 X |
| 3,564,472 | 2/1971 | Frowein | 336/100 X |
| 3,706,061 | 12/1972 | Loika, Jr. | 336/197 |
| 3,815,067 | 6/1974 | Koh | 336/178 X |

FOREIGN PATENT DOCUMENTS

| | | | |
|---|---|---|---|
| 184,360 | 6/1963 | Sweden | 336/100 |

*Primary Examiner*—Thomas J. Kozma
*Attorney, Agent, or Firm*—James H. Beusse; Albert S. Richardson, Jr.

[57] ABSTRACT

A reactor winding in the form of a high current, multi-turn, multi-layer insulated coil stack embracing an inner member of a magnetizable core assembly of a reactor is resiliently supported by the outer member of the core assembly by inserting a plurality of ripple spring sheets of non-magnetic material between the outer member and selected adjacent surfaces of the outer periphery of the windings. The inner core member is resiliently supported within the coil stack by an additional plurality of ripple spring sheets disposed between adjacent surfaces of the coil stack and inner core member. Ripple spring sheets are also positioned between adjacent surfaces of the inner and outer core members. The ripple spring sheets are preferably disposed between flat side sheets to provide uniform distribution of the spring forces.

11 Claims, 5 Drawing Figures

RESILIENTLY SUPPORTED WINDINGS IN AN ELECTRICAL REACTOR

BACKGROUND OF THE INVENTION

The present invention relates to electrical reactors and, more particularly, to a high current reactor in which current carrying windings are resiliently supported in a magnetizable core.

A reactor comprises one turn or more of an electrical conductor wound in a substantially closed loop. In a so-called iron core reactor the conductor is typically wound on at least one leg of a core of magnetizable material. To reduce heating of the core caused by eddy currents circulating in the core, the core is generally formed as a laminated structure. Under steady state conditions the reactor presents a relatively low impedance to direct current of constant magnitude and a relatively high impedance to alternating or otherwise undulating currents, the impedance varying substantially as a direct function of the frequency of the alternating current. Accordingly, if the winding is connected in series with a source of direct current having an appreciable ripple, its inductance is effective to smooth the current that flows to a connected load circuit. In high current applications (e.g., 1000 amperes or more), such smoothing reactors are typically large devices and can occupy a volume of as much as 70 cubic feet and weigh several tons.

The conductors forming the windings of these high current reactors are typically insulated copper bars of relatively large cross sectional area, e.g., the bars may be one inch wide and one-half inch thick. Windings formed of such conductors are generally wound in flat spiral layers with one end of the conductor terminating at the outer periphery of the layer and the other end of the conductor terminating at the inner periphery of the layer. A plurality of these "winding layers" may be stacked with suitable insulation between each layer to form a complete winding or "coil stack." The conductors may be selectively joined at respective inner and outer end terminals to form any desired combination of winding layers. For example, by connecting all the inner end terminals to a first common point and connecting all the outer end terminals to a second common point, a single reactor coil stack having all winding layers in parallel will be formed.

In order to minimize the size of such reactors, it is necessary to tightly compact the coil stack while at the same time providing adequate electrical insulation between the turns of each winding layer and between adjoining layers in order to prevent arcing or electrical breakdown between adjacent conductors. During operation of the reactor there is a tendency for the winding to more or vibrate due to thermal expansion or contraction, undulations in the magnetic forces exerted on the conductors, and mechanical vibrations of the supporting structure. Relative movement between adjacent winding layers or between individual turns of the winding layers will result in large frictional forces being exerted on the electrical insulation surrounding the conductor. Repetitive frictional forces can eventually result in electrical breakdown of the insulation with attendant arcing and other damage to the reactor and associated components.

Prior art attempts to solve the problem of insulation breakdown due to relative conductor movement have generally involved restricting the movement of the winding layers and turns by applying an external compressive force to the coil stack. Such a prior art construction is shown in U.S. Pat. No. 2,064,011 wherein an expansible closed hollow member is assembled as part of a coil stack in a transformer. After assembly of the coil stack within the transformer housing or outer core structure, a suitable filling compound is forced under pressure into the expansible member thereby forcing the member to expand and compress the coil stack. The filling compound is then allowed to set or harden before using the transformer. Such a construction is disadvantageous in at least two respects: the expansible member is metal which can adversely affect the alternating flux distribution in the device; and, due to the rigidity of the filling compound, when used in a vibrating environment frictional forces will tend to cause insulative spacers in the transformers to wear which can undesirably reduce the compressive forces exerted on the coil stack.

A more recently developed approach to this problem is illustrated in U.S. Pat. No. 3,170,131 wherein the filling compound is a compressible gas. This approach tends to overcome the problems of a solid filler since the gas will expand and compensate, albeit at a lower pressure, for any wear in the insulative spacers within the transformer structure. Although leakage of the gas from the expansible member creates another problem, the latter problem may be alleviated by periodically checking the gas pressure and replacing the gas as required. However, a further problem introduced by this approach is one of lateral support of the coil stack. In particular, the gas fill member under high compressive stress and lateral forces acts much like a balloon filled with air, i.e., it has very little resistance to lateral movement. Furthermore, with the high compressive forces necessary to minimize coil movement, the gas filled member has very low vibration damping ability even in the compressive direction.

As will be fully explained hereinafter, my invention utilizes ripple springs in the reactor assembly. Such ripple springs per se have previously been disclosed. A ripple spring typically comprises a corrugated sheet of alternating rises and valleys uniformly distributed across the surface area of the sheet, the sheet being formed of a stiff but bendable resilient material.

SUMMARY OF THE INVENTION

It is an object of the present invention to provide an improved mounting arrangement for current carrying windings in a high current reactor.

It is a further object of the present invention to provide an improved resilient mounting arrangement for current carrying windings in a high current reactor.

It is a still further object of the present invention to provide an improved mounting arrangement for current carrying windings in a high current reactor with increased vibration damping in both the compressive and lateral directions.

It is another object of the present invention to provide an improved reactor having a resiliently supported inner core member.

In carrying out the present invention in one form thereof, a reactor winding, in the form of a high current, multi-turn insulated coil stack embracisng an inner member of a magnetizable core assembly of a reactor, is resiliently supported by the outer member of the core assembly by inserting a plurality of ripple spring sheets of non-magnetic material between the outer members and selected adjacent regions of the outside periphery of the windings, respectively. The inner member of the core assembly is supported by the coil stack by virtue of an additional plurality of ripple spring sheets respectively disposed in compression between the inside periphery of the coil stack and selected adjacent sides of the inner core member. The inner core member is further supported by ripple spring sheets positioned between the inner core member and selected adjacent sides of the outer core member. Each ripple spring sheet is preferably disposed between flat side sheets to allow uniform distribution of the spring forces. The combination of the ripple spring sheet and of the opposed flat side sheets form a ripple spring asseembly.

During assembly of the reactor the spring assemblies are installed by "shoe-horning" or, in a preferred method, by sealing the edges of the spring assemblies with flexible tape and evacuating the sealed air-tight spring assembly whereby atmospheric pressure collapses the assembly. The collapsed spring assemblies are then inserted into appropriate positions in the reactor and allowed to expand by releasing the vacuum. Preferably the ripple springs and flat side sheets are constructed of electrically insulative material.

DESCRIPTION OF THE DRAWINGS

The subject matter which is regarded as the invention is particularly pointed out in the appended claims. The invention, however, both as to organization and method of practice, together with further objects and advantages thereof, ay best be understood by reference to the following description taken in conjunction with the accompanying drawings in which:

DETAILED DESCRIPTION

Figure 1:
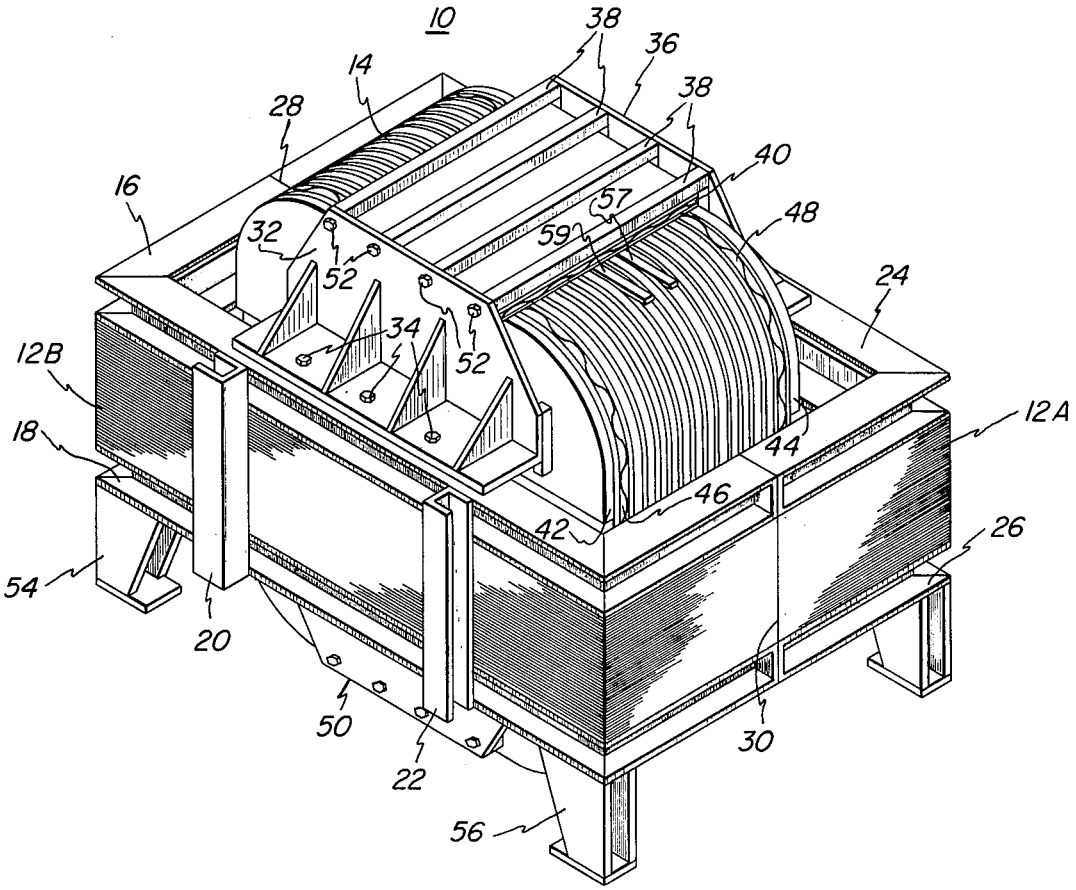
FIG. 1 is a perspective view of a typical high current reactor embodying the present invention.

Referring now to FIG. 1, there is shown a perspective view of a typical high current reactor 10 embodying the teachings of the present invention. Reactor 10 includes an outer core comprising first and second substantially U-shaped core members 12A and 12B substantially surrounding a winding or coil stack 14. Each of the members 12A and 12B includes a yoke portion spanning first and second legs which are disposed on opposite sides of the coil stack 14. The outer core is preferably a laminated magnetizable structure, and its laminations are held together by means of upper and lower substantially U-shaped metal beams such as, for example, I-beams, which beams conform to the shape of the core members 12A and 12B. In particular core member 12B is compressed between an upper metal I-beam 16 and a lower metal I-beam 18, which beams 16 and 18 are firmly joined together by means of U-shaped channels 20 and 22 extending perpendicular to the plane of the laminations of the outer core. Channels 20 and 22 are attached to beams 16 and 18 by means well known in the art, such as welding. Core member 12A is compressed between corresponding U-shaped I-beams 24 and 26, which beams are similarly joined together by means of another pair of channels (see FIG. 2). Core sections 12A and 12B are attached to each other by suitably fastening the ends of the I-beams 16 and 18 to the respectively abutting ends of the I-beams 24 and 26 to thereby form a generally rectangular outer core assembly substantially surrounding the coil stack 14. As is well known insulative spacers may be placed between the ends of the outer core members at their junctures 28 and 30 if air gaps in the magnetic structure of the reactor are desired.

As can be seen in FIG. 1, coil stack 14 is supported in the vertical direction within the outer core 12 by means of angle brackets and cross members associated with both the upper and the lower portions of the coil stack. In particular the upper portion of coil stack 14 is disposed between an angle bracket 32 attached to I-beam 16 by means of bolts 34 and a corresponding angle bracket 36 that is bolted to I-beam 24, and a plurality of parallel cross support members 38 that are fixedly attached to complete the upper support for coil stack 14. As illustrated in FIG. 1, the cross-support members 38 are arranged in quadrature with the legs of the U-shaped core sections 12A and 12B to thereby provide support on all four sides of the coil stack 14. Resilient mounting is provided between the supports 38 and coil stack 14 by means of a ripple spring assembly 40 positioned between the cross support members 38 and the top side of coil stack 14. Insulative spacers 42 and 44 placed on opposite sides of coil stack 14 serve to insulate the coil stack from the metallic brackets 32 and 36. Additional ripple spring assemblies 46 and 48 are located between the coil stack 14 and the spacers 42 and 44, respectively.

The lower portion of coil stack 14 is supported in a manner identical to the upper portion as previously described. In particular an angle bracket 50 attached to beam 18 and a corresponding angle bracket (not shown) attached to beam 26 with cross support members connected therebetween and another ripple spring assembly serve to support the lower portion of coil stack 14. In the illustrated embodiment the cross support members such as 38 are shown fastened to the angle brackets by means of bolts 52; however, it is to be understood that other suitable means (such as welding) for attaching the cross support members to the respective angle brackets may alternatively be utilized.

The entire reactor assembly is generally positioned in place as is illustrated in FIG. 1 and is supported by welded brackets or feet 54 and 56 attached to lower I-beam member 18 and by corresponding feet attached to the lower I-beam member 26. Electrical connection to the reactor winding or coil stack 14 is made by means of electrical terminals indicated generally at 57 and 59.

For ease of illustration reactor 10 will hereinafter be identified as having a near side corresponding to those portions associated with the yoke portion of member 12B, a far side corresponding to those portions associated with the yoke portion of member 12A, a left side and a right side corresponding to the left hand and right hand portions of the reactor as positioned in FIG. 1, an upper portion including the brackets 32 and 36 and the components associated therewith, and a lower portion including the bracket 50 and the components associated with this latter bracket.

In one embodiment a reactor constructed according to the present invention included a plurality of multi-turn winding layers interconnected to form a winding stack or a coil stack measuring approximately 48 inches by 48 inches by 18 inches thick. The inner core member measured approximately 22 inches by 22 inches by 18 inches and the outer core measured 72 inches by 72 inches by 40 inches thick. The complete reactor weighed approximately 11 tons and was rated for 3300 amperes at 1600 volts.

Figure 2:
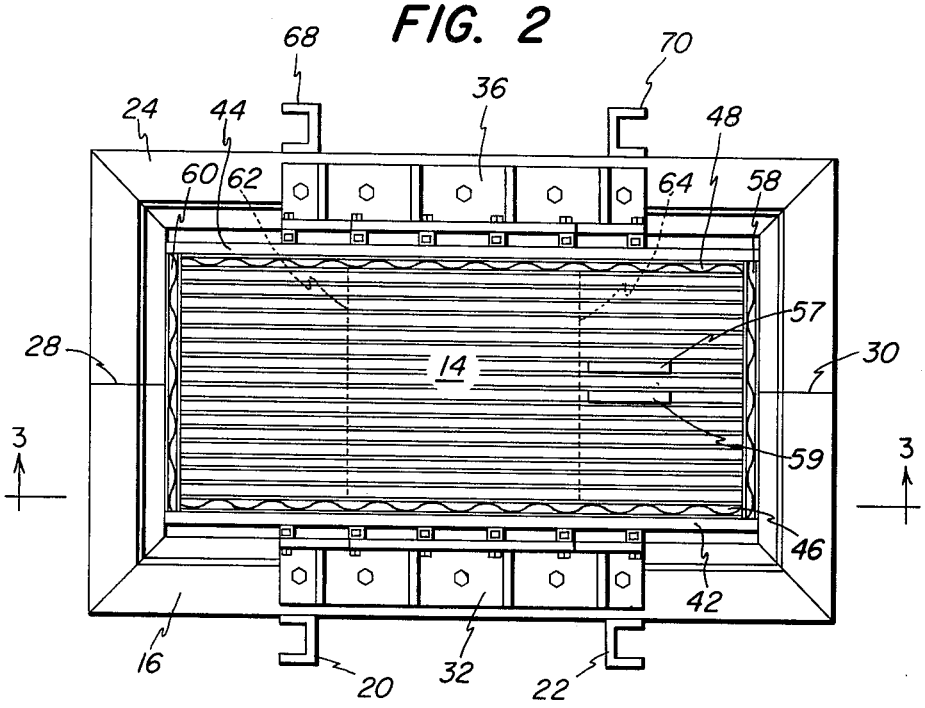
FIG. 2 is a plan view looking down on the reactor of FIG. 1 with the upper cross bar supports and ripple springs removed.

Referring now to FIG. 2, there is shown a plan view looking down on the top of the high current reactor 10 of FIG. 1 with the cross support members 38 and upper ripple spring assembly 40 removed. As is indicated in FIG. 2 the coil stack 14 is captured within a rectangular structure formed by the combination of the substantially U-shaped outer core members 12A and 12B subtending the opposing U-shaped support beams 16 and 24. The coil stack 14 is resiliently supported by and insulated from the outer core by means of a plurality of ripple spring assemblies disposed in compression between the coil stack 14 and the adjacent parts of the core. In particular the ripple spring assembly 46 is positioned between the front end of coil stack 14 and the yoke of the near-side U-shaped core member 12B, and the ripple spring assembly 48 is positioned between the other end of coil stack 14 and the yoke of the far-side U-shaped member 12A. An additional pair of ripple spring assemblies 58 and 60 are similarly positioned in spaces between the right and left sides of the coil stack 14 and the respectively adjacent parts of the outer core members.

The dotted lines 62 and 64 through the coil stack 14 in FIG. 2 indicate an opening through the center of these windings. Also indicated in FIG. 2 are the rear vertical U-shaped channels 68 and 70 which are provided to connect the upper and lower I-beams 24 and 26 together in order to clamp the laminations of the outer core member 12A.

Figure 3:
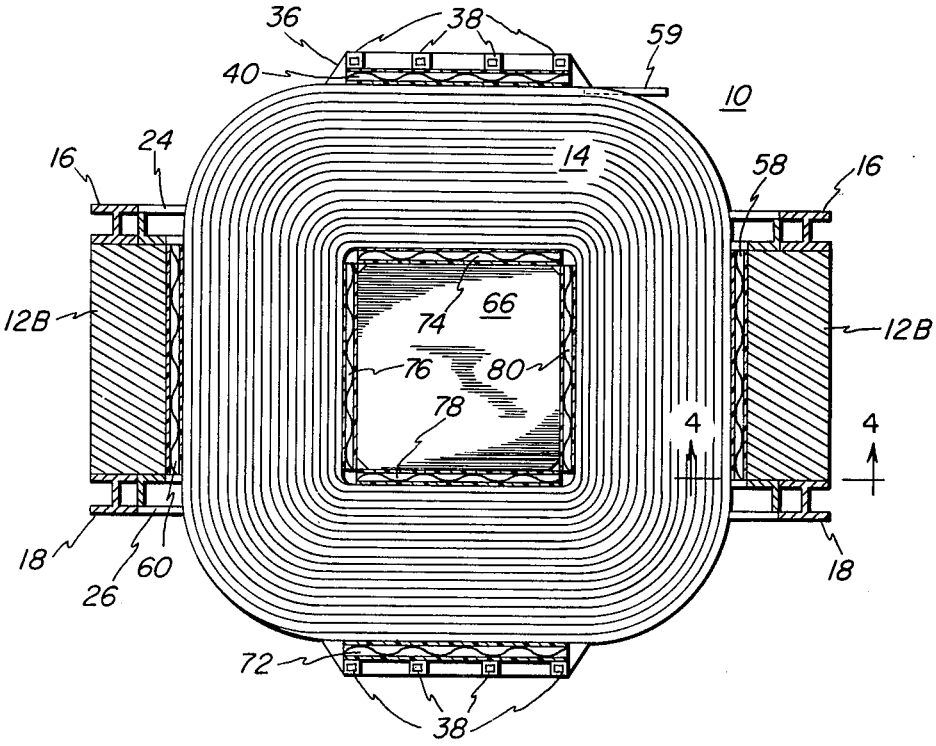
FIG. 3 is a sectional view of the reactor of FIG. 1 taken along the lines 3—3 of FIG. 2.

Referring now to FIG. 3, there is shown a sectional view of the reactor 10 taken along the lines 3—3 of FIG. 2. As can be seen the coil stack 14 is resiliently supported within the outer framework formed by the outer core and its appurtenances such as elements 36 and 38. As previously indicated, a ripple spring assembly 40 is located at the top side of coil stack 14 and appropriately spaces the coil stack from the cross members 38. It can also be seen that another ripple spring assembly 72 is utilized to space the bottom side of coil stack 14 from the lower supporting cross members 38.

An inner member 66 of the magnetizable core assembly of the reactor 10 is shown in FIG. 3, and in the preferred form of my invention it is encircled by the windings of the coil sack 14 but is spaced therefrom by means of four ripple spring assemblies 74, 76, 78, and 80 disposed in compression around the periphery of the inner core member 66 between this member and the adjacent sides of coil stack 14. Being resiliently supported by these ripple spring assemblies 74, 76, 78, and 80, the inner core member 66 substantially floats within the coil stack 14. From FIG. 2 it will be apparent that the inner core member 66 is also spaced from the outer core member 12 by means of the opposing ripple spring assemblies 46 and 48, whereby short air gaps are inroduced in the magnetic path provided by the core assembly of the reactor.

Figure 4:
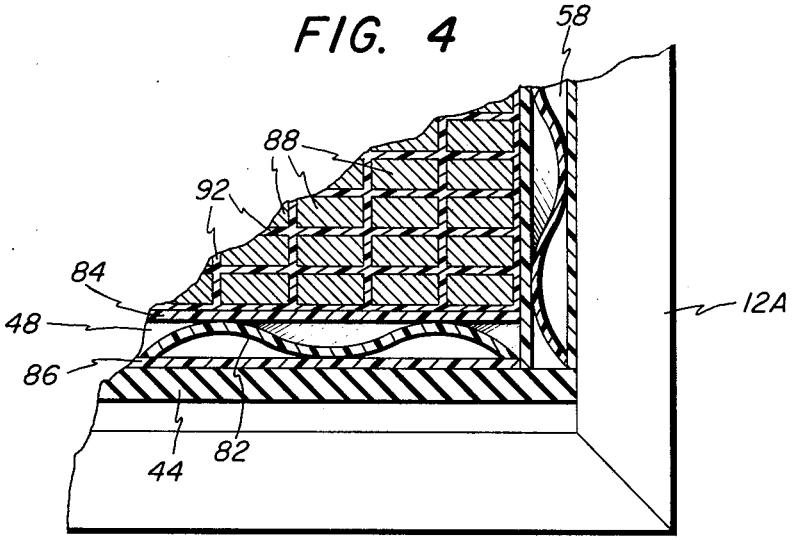
FIG. 4 is an enlarged partial cross sectional view taken along the line 4—4 in the reactor of FIG. 3 showing a detail of a ripple spring assembly.

Referring now to FIG. 4 there is shown a partial cross-sectional area of the reactor 10 taken along the lines 4—4 of FIG. 3. As can be seen the ripple spring assembly 48 comprises a ripple spring member 82 disposed between juxtaposed flat side sheets 84 and 86. Also shown in FIG. 4 is a cross-sectional view of the copper bars 88 forming the individual turns of the coil stack 14. It is noted that suitable electrical insulating material 92 of a type well known in the art such as, for example, a polyester glass material, is spaced around and between the individual turns of the coil stack. As indicated ripple spring assembly 58 is constructed identically to assembly 48 and is typical of the spring assemblies utilized in the present invention.

Figure 5:
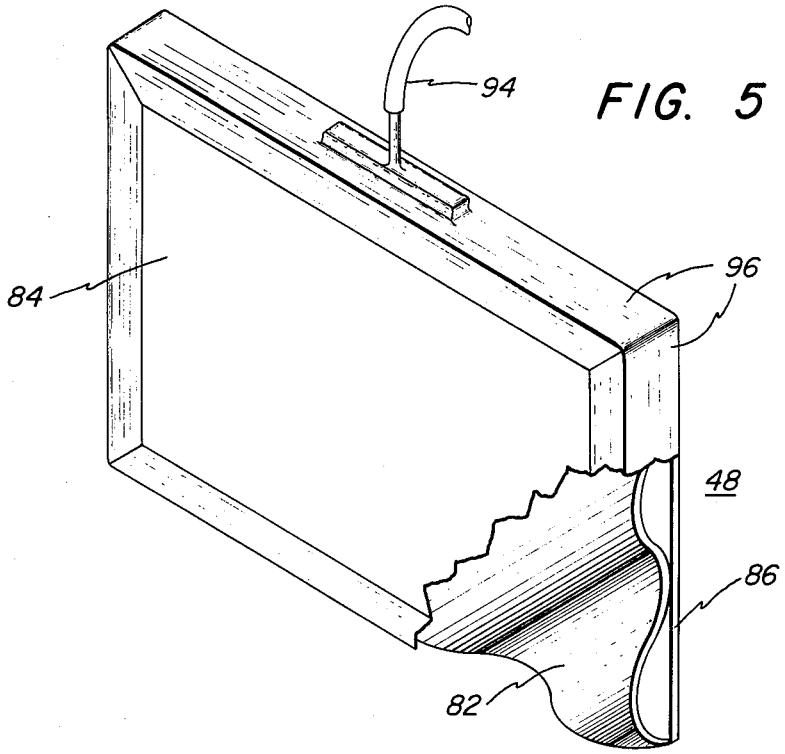
FIG. 5 is a perspective view of a ripple spring assembly.

Referring now to FIG. 5 there is shown a perspective view with a partial cutaway of a ripple spring assembly as utilized in the present invention such as, for example, ripple spring assembly 48. As can be seen ripple spring assembly 48 comprises first and second flat side sheets 84 and 86 disposed in substantially parallel planes on opposite sides of ripple spring sheet 82. For purposes of compressing the spring assembly for insertion in the spaces between the reactor coil stack 14 and the outer core, or between the inner core member 66 and between the core stack 14, the edges of the ripple spring assembly are sealed by means of a flexible tape generally indicated at 96, which tape may be, for example, a plastic film tape sold under the trademark Mylar. The spring assembly may then be compressed by inserting therein a hose assembly such as that indicted at 94 and attaching to the hose assembly a vacuum pump (not shown) of a type well known in the art for evacuating the air from the assembly and allowing the outside atmospheric pressure to collapse the spring. In some instances it has been found convenient to manually depress the spring assembly by applying an external force in addition to the atmospheric air pressure while extracting the air from within the assembly. As can be seen FIG. 5 the spring sheet 82 is arranged to have the hills and valleys run diagonally of the spring assembly. This arrangement provides substantially equal lateral resistance to movement in both the vertical and horizontal directions.

Where the relative change in the thickness of the ripple spring assembly between the compessed and uncompressed stages is slight, the ripple spring assembly may be more easily inserted into the small apertures between the coil stack and the core members if a lubricant is placed on the outer surfaces of the flat side sheets. Alternatively, thin sheets of plastic film such as, for example, the film sold under the trademark Teflon, may be placed between the core assembly and the ripple spring assembly to aid in sliding the spring assembly into the small aperture.

The ripple spring sheets such as spring sheet 82 are preferably constructed of a non-magnetic insulating material, a suitable material for the spring member being a glass fiber or glass fabric which is impregnated wih a curable plastic, such as a polyester resin. These spring members may be manufactured by impregnated one or more layers of glass fabric with a curable resin and causing the resin to cure while holding the fabric in a mold of ripple shape. The opposed flat side sheets such as sheets 84 and 86 are likewise preferably constructed of a non-magnetic insulating material such as a glass fiber polyester resin impregnated material.

To further illustrate the preferred construction of ripple springs useful in practicing my invention, the spring used in the assembly 40 (see FIGS. 1 and 2) was actually made from a sheet of polyester glass fiber material impregnated with a curable polyester resin that was approximately 24 inches long, 24 inches wide, and 35 mils thick, with the amplitude of the ripple being 240 mils before compression. The flat side sheets are made from the same material but are typically 60 to 90 mils thick. The material used in the spring assembly resulted in a spring which typically exerted a force of about 10 pounds per square inch.

The reactor 10 is assembled by constructing a first half of the outer core assembly, such as that half including the near-side core member 12B and attaching thereto the support members 16 and 18 with channels 20 and 22 fixedly attached. Angle brackets 32 and 50 are then attached, and the resulting subassembly is positioned with the yoke of the outer core member 12B lying on its back. The front end of each of the cross support members 38 is thereafter attached to the corresponding angle bracket 32, 50. Insulator 42 and the front end ripple spring assembly 46 are then placed in position on this subassembly, and coil stack 14 is laid over ripple spring assembly 46. Subsequently the ripple spring assemblies 40, 58, 60, and 72 are inserted in their compressed states around the coil stack periphery.

In some instances it has been found convenient to assemble the inner core member 66 prior to inserting ripple spring assemblies 40, 58, 60, and 72. Inner core member 66 is lowered into the center of the coil stack 14 on top of ripple spring assembly 46, and ripple spring assemblies 74, 76, 78, and 80 are then compressed and inserted into corresponding spaces between core member 66 and coil stack 14. Expansion of spring assemblies 74, 76, 78, and 80 thereafter maintains core member 66 resiliently but securely positioned within coil stack 14.

Before lowering the second half of outer core assembly into position, ripple spring assembly 48 is placed on top of the upwardly facing back end of the coil stack 14. The far-side outer core member 12A (previously subassembled with I-beams 24 and 26, channels 68 and 70, and associated angle brackets) can now be assembled by fastening its angle brackets to the back ends of the cross support members 38 and by fastening together the abutting ends of the opposing U-shaped beams 16, 24 and 18, 26, respectively. Thereafter the ripple spring assemblies 40, 58, 60, and 72 are allowed to expand and exert compressive force on coil stack 14. Thus coil stack 14 is securely but resiliently mounted within an outer core structure while inner core member 66 is resiliently supported inside the coil stack 14.

The reactor structure and assembly procedure hereinbefore described results in relative movement of the windings of the reactor being effectively restricted while providing a predetermined amount of resiliency in both compressive and lateral directions to thereby allow the inner and outer core to respond to sudden shocks without transferring the shock to the coil stack. In addition, the ripple spring assemblies are ideally suited to absorb thermal expansion and contraction. Furthermore, the vibration damping ripple spring assemblies are constructed of non-magnetic insulating material and thus provide electrical insulation between coil and core and do not adversely affect the inductive characteristics of the reactor assembly.

Although the invention has been described with reference to a particular embodiment thereof, it is to be understood that other modifications, arrangements and constructions thereof will occur to those of ordinary skill in the art. For example, although the reactor 10 has been described as employing a maximum number of ripple spring assemblies, i.e., a spring assembly is positioned between coil stack 14 and each adjacent surface, it will be apparent to those skilled in the art that in some applications, such as, for example, a lighter weight coil stack, fewer spring assemblies may be required to provide adequate resilient mounting for the coil stack. In addition, some applications may also permit omission of the opposed flat side sheets in all or some of the spring assemblies. The invention, therefore, is not intended to be restricted except insofar as is necessitated by the prior art and is intended to include all such modifications, arrangements, and constructions falling within the true spirit and scope of the appended claims.

What is claimed as new and desired to secure by Letters Patent of the United States is:

1. In an electrical reactor:

a. a stack of interconnected electrical windings;

b. a magnetizable core having outer members formed in a generally rectangular assembly substantially surrounding said windings and having an inner member disposed inside said windings;

c. at least one pair of cross members respectively disposed adjacent to sides of said windings in quadrature with said outer members and each having opposite ends fixedly attached to said outer members; and d. resilient means for restricting relative movement of said windings, said resilient means comprising:

i. a first ripple spring assembly disposed in compression between said windings and a part of said outer members that is adjacent to said windings, ii. a second ripple spring assembly disposed in compression between said windings and a part of said inner member that is adjacent to said windings, and iii. a third ripple spring assembly disposed in compression between said windings and a first one of said cross members, each of said ripple spring assemblies comprising an insulating sheet impregnated with a curable plastic resin and formed in a substantially uniform ripple pattern.

2. The reactor as defined in claim 1 and including a plurality of ripple spring assemblies located such that at least one ripple spring assembly is disposed in compression between said winding stack and each adjacent part of said outer core members.

3. The reactor of claim 1 wherein said outer core members comprise first and second legs positioned respectively on opposite sides of said windings and first and second yoke portions positioned respectively along the top and bottom of said windings, said first ripple spring assembly being disposed between said windings and a side of said first leg adjacent to said windings, and including a fourth ripple spring assembly disposed in compression between said windings and a side of a selected one of said yoke portions adjacent to said windings.

4. The reactor of claim 3 in which said resilient means additionally comprises a fifth ripple spring assembly disposed in compression between said winding stack and said inner core member, said fifth ripple spring assembly being located on a side of said inner member perpendicular to the side wherein said second ripple spring assembly is located.

5. The reactor of claim 1 in which said movement restricting means additionally comprises four ripple spring assemblies arranged in quadrature around said inner member between it and the inside periphery of said winding stack.

6. The reactor as defined in claim 1 wherein each ripple spring assembly comprises:

a. first and second substantially parallel opposed flat side sheets; and b. a ripple spring member disposed between said first and second side sheets.

7. The reactor as defined in claim 6 wherein said ripple spring assembly comprises a glass fiber sheet impregnated with a curable plastic resin and formed in a substantially uniform ripple pattern.

8. The reactor as defined in claim 1 wherein said ripple spring assembly is a relatively thin, substantially rectangular assembly having the corrugations of said ripple spring sheet running diagonally of the spring assembly.

9. The reactor of claim 1 and including ripple spring assemblies positioned at opposite ends of said inner member between it and said outer members.

10. The reactor of claim 3 wherein said fourth ripple spring assembly extends through a gap between an end of said inner member and said selected yoke portion.

11. The reactor as defined in claim 6 and including:

a. means for flexibly joining and sealing the edges of said opposed flat side sheets to form a substantially air tight enclosure about said ripple spring member; and b. means associated with said ripple spring assembly for allowing air to be evacuated from said assembly whereby said assembly may be compressed by external air pressure to facilitate installation in said reactor.

* * * * *